United States Patent [19]

Stessen

[11] Patent Number: 4,611,772

[45] Date of Patent: Sep. 16, 1986

[54] METHOD OF INCREASING THE EFFECTIVENESS OF TARGET-SEEKING AMMUNITION ARTICLES

[75] Inventor: Lothar Stessen, Lauf, Fed. Rep. of Germany

[73] Assignee: Diehl GmbH & Co., Nuremberg, Fed. Rep. of Germany

[21] Appl. No.: 624,573

[22] Filed: Jun. 26, 1984

[30] Foreign Application Priority Data

Nov. 30, 1983 [DE] Fed. Rep. of Germany ..... 3343259

[51] Int. Cl.[4] ..... F41G 7/22

[52] U.S. Cl. ..... 244/3.16; 244/3.15

[58] Field of Search ..... 89/1.11; 244/3.15, 3.16, 244/3.19, 3.1

[56] References Cited

U.S. PATENT DOCUMENTS

| | | | |
|---|---|---|---|
| 3,064,924 | 11/1962 | Fairbanks | 244/3.16 |
| 4,004,487 | 1/1977 | Eichweber | 244/3.15 |
| 4,267,562 | 5/1981 | Raimondi | 89/1.11 |
| 4,394,997 | 7/1983 | Maudal | 244/3.16 |
| 4,444,110 | 4/1984 | Lindner et al. | 102/213 |
| 4,497,065 | 1/1985 | Tisdale et al. | 244/3.15 |
| 4,522,356 | 6/1985 | Lair et al. | 244/3.15 |

FOREIGN PATENT DOCUMENTS

| | | | |
|---|---|---|---|
| 2949453 | 6/1981 | Fed. Rep. of Germany | 244/3.16 |
| 1270729 | 4/1972 | United Kingdom . | |

*Primary Examiner*—Charles T. Jordan

*Attorney, Agent, or Firm*—Scully, Scott, Murphy & Presser

[57] ABSTRACT

A method for increasing the effectiveness of the utilization of target-seeking ammunition articles, which include a sensor scanning a predetermined searching surface within the target area for target criteria in order to suppress dummy targets during evaluation for steering towards or homing on the target. Upon the detection of a target within pregiven target surroundings, a search is conducted thereabout for a further target, and after detecting a predetermined number of such types of neighboring targets, one such target is approached.

3 Claims, 1 Drawing Figure

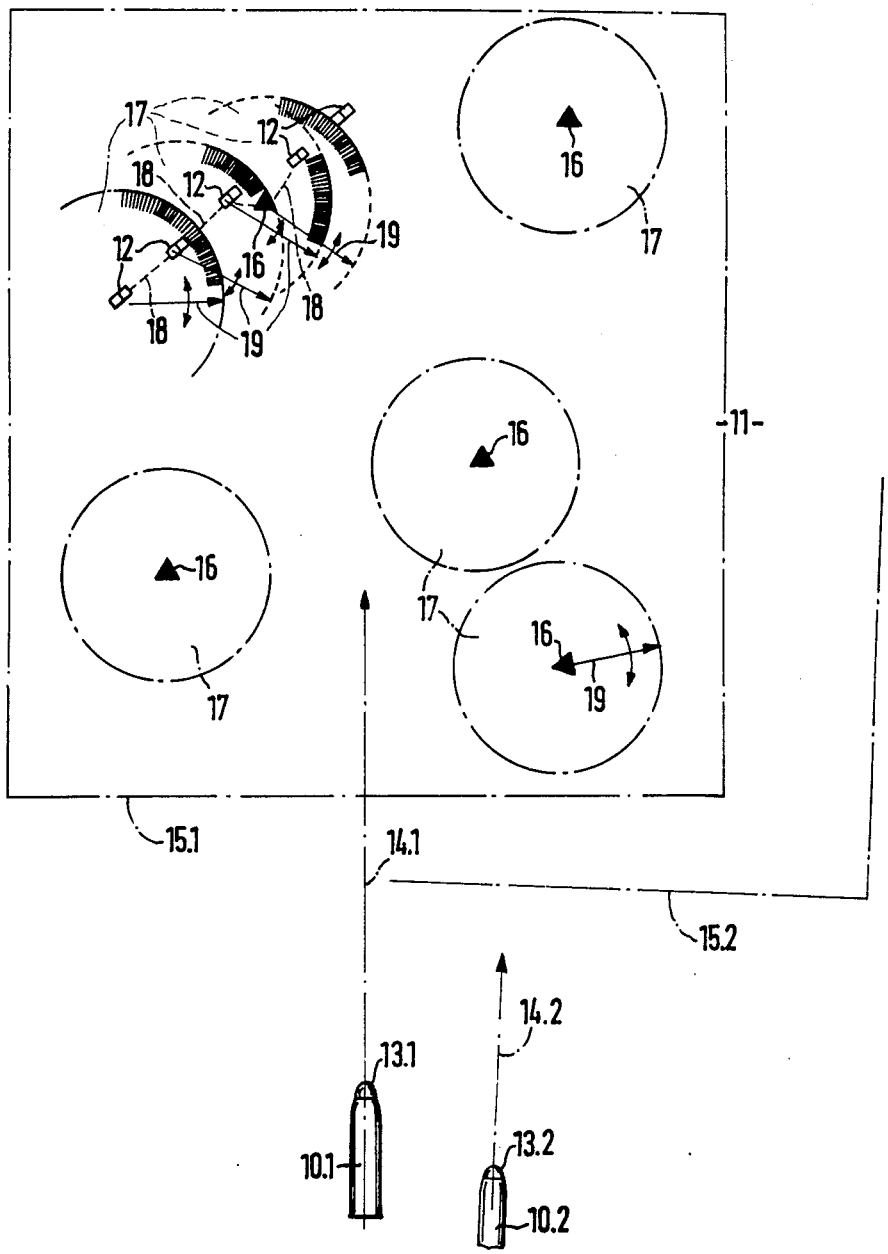
17
12
18
12
19
12
16
18
18
19
16
17
16
-11-
16
17
16
17
19
15.1
14.1
15.2
14.2
13.1
13.2
10.1
10.2

METHOD OF INCREASING THE EFFECTIVENESS OF TARGET-SEEKING AMMUNITION ARTICLES

BACKGROUND OF THE INVENTION

1. Field of the Invention

The present invention relates to a method for increasing the effectiveness of the utilization of target-seeking ammunition articles, which include a sensor scanning a predetermined searching surface within the target area for target criteria in order to suppress dummy targets during evaluation for steering towards or homing on the target.

The employment of such methods is implemented for target-seeking ammunition in order to possibly avoid any attack against dummy targets and, thereby an ineffective utilization of the ammunition. This so-called intelligent ammunition can relate in the same measure to ballistically-fired ammunition, as well as to ammunition with their own propulsion devices (remote-controlled or self-steering projectiles or missiles); so that when, hereinafter, for purposes of simplifying the representation there is set forth a discussion of projectiles, no restriction is meant to apply to any specific types of target-seeking ammunition.

2. Discussion of the Prior Art

The usual methods of the foregoing technological type are based on an extraction of target data which are obtainable by means of active or passive position-finding devices; for instance, from the geometry, the radiation characteristics or the kinematics of targets of interest through means for mathematical data processing on board of the projectile in comparison with pregiven typical properties of this type, in order to avoid an attack against dummy targets, and to ensure favorable attack conditions for an optimum probability of disabling the target of interest. A typical example of data-processing techniques which can be employed for this purpose is described in German Patent No. 29 49 453 for a complex system, or is described in U.S. Pat. No. 4,444,110 for a simpler target-detection sensor system.

SUMMARY OF THE INVENTION

The present invention is predicated on the recognition that with representable signal processing technology applied to the searching surface which is scanned by the sensor of the projectile within the target area, there cannot be implemented the separation out or distinguishing of collective dummy targets, inasmuch as there will always remain a few detected target locations which cannot be distinguished with regard to the evaluated criteria from actual real targets of interest, or in any case not with the necessary degree of certainty. As a result, there is produced a certain degree of probability of attacking a false target; in essence, a predetermined limit to the effectiveness of the utilization of the projectile with respect to the intended disabling of real targets which are of actual interest.

Based on this recognition, it is an object of the invention that even after exhausting all realistic technological signal-processing capabilities with respect to the target information which is obtained within the searching surface, to find a further criterium for the distinction of real targets in comparison with the still remaining false targets, and to thereby achieve an increase in the effectiveness of the utilization of the projectiles.

The foregoing object is essentially achieved through a method of the above-mentioned type in that presently, upon the detection of a target within pregiven target surroundings, a search is conducted thereabout for a further target, and after detecting a predetermined number of such types of neighboring targets, one such target is approached.

The foregoing object is also based on the recognition that in a combat zone, typical real targets, such as vehicle columns, will be encountered relatively frequently, and thereby will exhibit a substantially smaller average distance or spacing with respect to each other in contrast with false targets which can no longer be eliminated by position-finding techniques within the bounds of the searching surface. Isolatedly encountered false targets which are dispersed within the searching surface are thereby characterized in that they will be individually encountered within a certain target region; whereas real targets located within a comparable target region will presently at least be located proximate to one further target. Based on this recognition, the false targets will be most extensively precluded during steering towards or homing onto a target, that only such targets will be considered which are located at a pregiven proximity with at least one further target, from which there again is conducted a search for a closely adjacent further target, and so forth. When, in this manner, during approach to the target area there is detected within the searching surface a series of relatively closely neighboring targets, then with a high degree of probability this relates to real targets, in all instances with individual false targets dispersed therein; isolated located (false) targets in the searching surface are not conducive to such a series formation in the detection of relatively closely neighboring targets, and thus will not be considered during the target approach or homing in of the projectile. An attack against a target then follows only when such a series of neighboring targets is determined to be above a certain number. Upon the firing of a plurality of projectiles into the same target area; in effect, with mutually overlapping searching surfaces, provision can also be made that the different projectiles are preset to a different number of targets which are detected in sequence within the series or chain, in order to possibly avoid superfluously attacking a single target a number of times.

In this manner, already for the individual projectiles, but first really with regard to the employment of a large number of projectiles fired in a spread will there significantly rise the degree of effectiveness, namely the probability of destroying real targets which are of actual interest, beyond the degree of probability which can be achieved through the usual means for target extraction from position-finding criteria; whereby there is obtained a still further increase in the effectiveness in that the searching or tracking surface of each projectile can be noticeably increased, inasmuch as its attacking mechanism will no longer be deflected by individual dummy targets present therein, and since through the thereby given overlapping of the searching or tracking surfaces, a plurality of parallel approaching projectiles can avoid their concentration on a single real target through different input data of the number of separating points of the real target series.

BRIEF DESCRIPTION OF THE DRAWING

Additional modifications and embodiments, as well as further features and advantages of the invention, can be ascertained from the following detailed description of an actual example for the utilization of the inventive method, as shown generally schematically in the single FIGURE of the drawing, in which there are illustrated mutually displaced projectiles approaching a target area with a typical distribution of real and false targets in a searching or tracking surface bounded within the target area.

DETAILED DESCRIPTION

The projectiles 10.1, 10.2 which are illustrated in the lower portion of the drawing are fired, for example, in a fan or spread pattern in the direction towards a target area 11, in which there have been discovered or there are presumed to be targets 12 which are to be attacked. Preferably, the foregoing relates to projectiles 10 which in the final phase of flight are self-controlled and target-seeking. In every instance are the projectiles 10 equipped with sensors 13 which, sloping forwardly, angled relative to the current direction of flight 14 towards the target area 11, scan a searching or tracking surface 15, in order to determine, by means of active or passive position-finding techniques, target criteria from the searching surface 15. On board of the projectiles 10, this information received from the searching surface 15 is processed, for instance, pursuant to the rule of mathematical statistics (in effect, by means of correlation techniques) in order to distinguish real or genuine targets 12 from apparently dummy-like false target 16. However, in actual practice, it must also be taken into calculation that at least few of the false targets 16, because of their geometry, their radiation characteristics or similar criteria are not clearly distinguishable from the genuine targets 12 which are alone of interest. Within the searching surface 15, at realistic data processing demands on the projectiles 10, besides the genuine or real targets 12 contained therein, there are also detected false targets 16 (but no longer distinguishable on the basis of their target criteria), the attacking of which would not be worthwhile; in effect, would not add to the effectiveness of the technological combat applications of the projectiles 10. This effectiveness becomes poorer when the searching surface 15 is increased relative to the respective projectile 10, inasmuch as the number of the false targets 16 which can no longer be distinguished as such is increased thereby, whereas, on the other hand, upon a reduction in size of such a searching surface 15, there is encountered the danger that the real targets 12, which are located along its boundaries will drop out of the searching surface and can no longer be attacked at all by the projectile 10. In accordance with the type of constructive equipment conditions of a projectile 10 and the expected terrain and target conditions within the target area 11, through the use of mathematical models there can thus be calculated an optimized searching surface 15 and thereby the statistical effectiveness of the utilization of projectiles 10.

The projectiles 10 which are considered herein, or other target-seeking ammunition articles which come into consideration as spread-fired ammunition, are usually not employed against individual targets, but at locations wherein, in the target area 11, there is given or expected a collection of real or genuine targets 12 which are to be attacked. This will provide the result that, after the real or genuine target extraction within the searching surface 15 there will be locally encountered a target collection which relates for the largest part to real targets 12; in effect, at most with a few singly false targets 16 dispersed therein. The remaining information over a target which is singly dispersed over the remaining area of the searching surface 15 is thereby associated, with the greatest probability, not with real but with false targets 16, which in the interest of the effectiveness of the utilization of the projectiles 10 are not considered during their search for targets, and should thus not be attacked. For this purpose, the target homing arrangement in the projectile 10 is designed for the purpose that every target location 12/16 still remaining after the target extraction in the searching surface 15, has a target surrounding 17 searched for the presence of a relatively closely neighboring further target location 12/16. In the event that within a target surrounding 17 there cannot be located any further target location 12/16, then this target 16 is interpreted as being "false" and will be ignored during homing onto a target. However, in the event that there is determined within the target surrounding 17 the presence of (at least) one further target location 12/16, under the displacement of the flight trajectory 14, a search is conducted in and about the target surrounding 17 for further target locations 12/16. Thus, when there is detected a series of positions of target points 12-12-16-12-12—within the searching surface 15, which are relatively closely neighboring to each other and thereby, with a great degree of probability, and in any event are overwhelmingly associated with real or genuine targets 12. An attack on one of these locations in a series of target points 18 thus leads with the greatest probability to the disabling of a real target 12 and, as a result, to the effective employment of the projectile 10; in essence, the effectiveness of the utilization of the projectile 10 is quite significantly increased thereby such that, notwithstanding reaching of the limits of target extraction through position-finding techniques, the false targets 16 which are still detected within the searching surface 15 can be ignored, insofar as by chance they do not lie in close proximity to a collection of real targets 12.

The radius 19 of the target surroundings 17 for the search after a series of target points 18 is again optimizable in accordance with the measure of the terrain conditions in the target area 11 and the type of the targets 12 which are to be attacked and their expected distribution, pursuant to the rules of probability computations, in order to ensure that for a typical distribution of real targets 12, the series of target points 18 will not terminate prematurely, but will extend over as many real targets 12 as possible; whereas on the other hand, with excessively large target surrounding 17 about the target points 12/16, false target 16 arranged therein can be introduced into the buildup of the series of target points 18, and thereby there can be interrupted the advance to a neighboring actual genuine target 12.

In the projectile 10, a switch to attack, in effect from the target searching phase to the homing onto a genuine target 12 which is to be attacked is only effected when the series of target points 18 can be set up through a pregiven number of support elements in the form of further target points 12/16 which are presently located in the target surroundings 17. It is simplest in the signal processing technology to attack the most recently detected target 12; in effect, the momentary final end point of the series of target points 18. Basically, however, there can be stored in a memory the position of a trailing support element of the series of target points, and the attack, while considering the path which has been traversed in the interim in the direction of flight 14, is then directed against this target 12.

Since for a fan or spread-like firing of a plurality of projectiles 10, their searching surfaces 15 can extensively overlap, and thereby a large collection of real targets 12 can be simultaneously evaluated in a plurality of projectiles 10 for presently one series of target points 18 as the attack criterium, this will lead to a noticeably greater increase in the effectiveness of the utilization of the projectiles 10, when the projectiles 10 which are fired almost simultaneously into the same region of the target area 11 are preset to the detection of a different number of target points 12/16 in the course of the formation of the series of target points 18. It is through the spatial and timewise displacement of the breakoff of the series of target points 18 that the probability increases that the different projectiles 10 will attack different real or genuine targets 12, thus avoiding an effectiveness-reducing multiple attack of projectiles 10 against one and the same, and possibly already destroyed target 12.

What is claimed is:

1. In a method for increasing the effectiveness of the utilization of target-seeking ammunition articles, including a sensor in each said article for scanning a pregiven searching surface within a target area pursuant to predetermined target criteria; the improvement comprising: effecting a search for a further neighboring target possessing said preselected target criteria upon detection of a first target possessing said predetermined target criteria within pregiven target surroundings about said first target; and upon detecting of a pregiven number of such neighboring targets possessing said predetermined target criteria, homing said article onto one of said targets.

2. Method as claimed in claim 1, including homing said article onto the last target of a series of target points built up from neighboring targets.

3. Method as claimed in claim 2, wherein a plurality of said ammunition articles homing onto the target area upon traversing mutually overlapping searching areas has each one of said articles directed towards another number of neighboring targets being sequentially detected as the criterium for the series of target points.

* * * * *